United States Patent [19]

Tillmanns

[11] 3,944,091

[45] Mar. 16, 1976

[54] SECURING MEANS OF REPLACEABLE WEARING PLATES IN SMASHING MACHINES

[75] Inventor: Josef Tillmanns, Dusseldorf, Germany

[73] Assignee: Lindemann Maschinenfabrik GmbH, Dusseldorf, Germany

[22] Filed: Jan. 27, 1975

[21] Appl. No.: 544,314

[30] Foreign Application Priority Data

Feb. 9, 1974 Germany ..... 2406205

[52] U.S. Cl. ..... 241/285 A; 241/182; 241/294; 241/300

[51] Int. Cl.[2] ..... B02C 13/282

[58] Field of Search ..... 241/181–183, 241/285 A, 294, 295, 299, 300

[56] References Cited

UNITED STATES PATENTS

| | | | |
|---|---|---|---|
| 1,534,000 | 4/1925 | Baker | 241/183 |
| 2,885,156 | 5/1959 | Fitz et al. | 241/182 |
| 3,378,209 | 4/1968 | Crocheron | 241/182 X |
| 3,473,746 | 10/1969 | Sabel | 241/299 |
| 3,503,564 | 3/1970 | Adam | 241/300 X |
| 3,802,634 | 4/1974 | Mix | 241/183 |
| 3,834,633 | 9/1974 | Dougall et al. | 241/295 |

*Primary Examiner*—Granville Y. Custer, Jr.
*Assistant Examiner*—Howard N. Goldberg
*Attorney, Agent, or Firm*—Toren, McGeady and Stanger

[57] ABSTRACT

A material smashing machine, such as a breaking or crushing machine, including a housing in which at least a portion of its wall is lined by a stationary wearing wall against which, in use, the material to be broken or crushed is beaten, ground or otherwise smashed. The wearing wall is formed by a number of replaceable wearing plates, each of which has at least one eyelet projecting outwards through an opening in the housing wall, and which is retained against the inside of the housing wall by a wedge inserted into the eyelet and bearing against the outside of the housing wall, and a releaseable, self-locking clamping piece acts upon the wedge in the direction of its insertion into the eyelet.

3 Claims, 2 Drawing Figures

II
1
2
3
4
5
6
7
8
9
10
11
12
13
14
15
16
17

I
I
1
2
4
5
8
11
13
16
17

SECURING MEANS OF REPLACEABLE WEARING PLATES IN SMASHING MACHINES

BACKGROUND OF THE INVENTION

This invention relates to breaking or crushing machines, particularly hammer crushers, which comprise a housing having a stationary wearing wall against which the material to be broken or crushed is beaten, ground, or otherwise smashed, usually by hammers mounted on a rotor which revolves within the housing.

The wearing wall is usually composed of a number of individual replaceable wearing plates which are removably fixed on the inside of the housing wall. However, the fixing of the wearing plates onto the housing wall of the machine poses certain problems, because the wearing plates are naturally subject to wear, whereas the fixing means are not. Therefore the most obvious way of fixing, namely that of screwing the wearing plates to the wall, is generally unsuitable because the screw connections also wear away as the plates wear and thereby lose their holding action.

Attempts have been made to overcome this fixing problem, and one example of such an attempt is disclosed in German Auslegeschrift No. 1,249,646. The solution proposed is however not completely satisfactory. In the fixing disclosed, an eyelet formed on the rear face of the wearing plate remote from the wearing surface projects outwards through an opening in the wall of the housing, and a wedge bearing against the wall is inserted into this eyelet. Screw connections are therefore avoided, but because the wearing plates are subjected to severe impacts, especially in the processing of materials which offer appreciable resistance to crushing, the wedges can sometimes become loose. It must be remembered that the wearing plates are components which are worn away and periodically must be replaced, and are therefore components for which a high manufacturing cost is unacceptable. Consequently the eyelets are not particularly accurately formed and it cannot be expected that the engaging surfaces of the wedges and eyelets will bear evenly one against another.

SUMMARY OF THE INVENTION

The present invention is also concerned with breaking or crushing machines of the kind described in which at least one eyelet formed on each wearing plate penetrates outwards through an opening in the housing wall and into which a wedge is inserted to act between the outside of the wall and the eyelet to hold the plate against the inside of the housing. The object of the invention is to arrange that each wedge cannot become loose even under the action of intense impact stresses, and according to the invention this is achieved by providing that each wedge is acted upon in its direction of insertion into its eyelet by a releasable, self-locking clamping piece.

Each clamping piece, which may be a threaded bolt with self-locking thread, may be mounted on the rear face of the corresponding wearing plate itself, that is, it can bear against the wearing plate itself. For this purpose, the wearing plate may be provided with an additional eyelet projecting through the housing wall and having a threaded hole for the self locking bolt. Preferably however, the clamping piece consists of a turnbuckle, one of the two adjustable parts of which acts on the wedge in its direction of insertion, and the other adjustable part of which acts in the opposite direction on another wedge which is inserted into another eyelet. In this case the second wedge may help to fix the same wearing plate as the first wedge, and the wearing plate will therefore have two eyelets, one for each wedge. The second wedge may, however, be associated with an adjacent wearing plate.

BRIEF DESCRIPTION OF THE DRAWING

The fixing of a wearing plate in one example of a machine in accordance with the invention is illustrated in the accompanying drawings, in which.

DETAILED DESCRIPTION OF THE INVENTION

Figure 1:
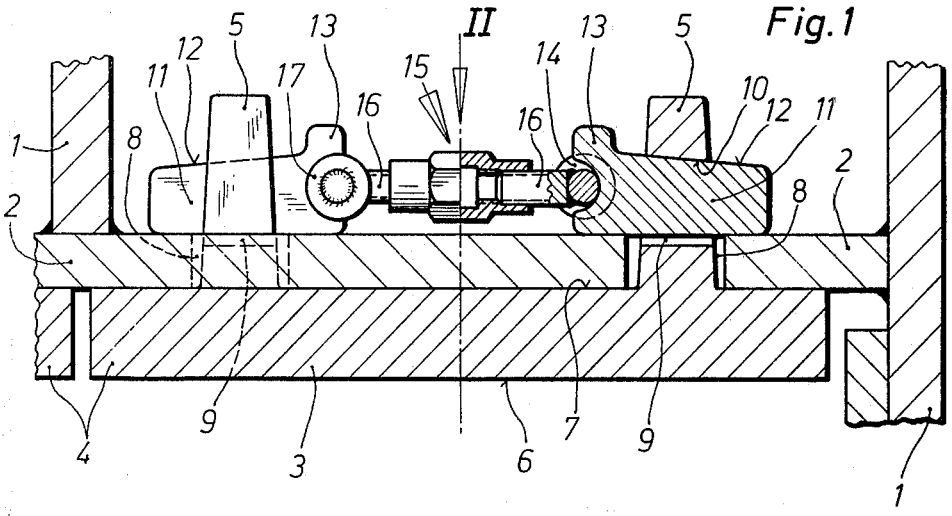
FIG. 1 is a section along the line I—I in FIG. 2.
Figure 2:
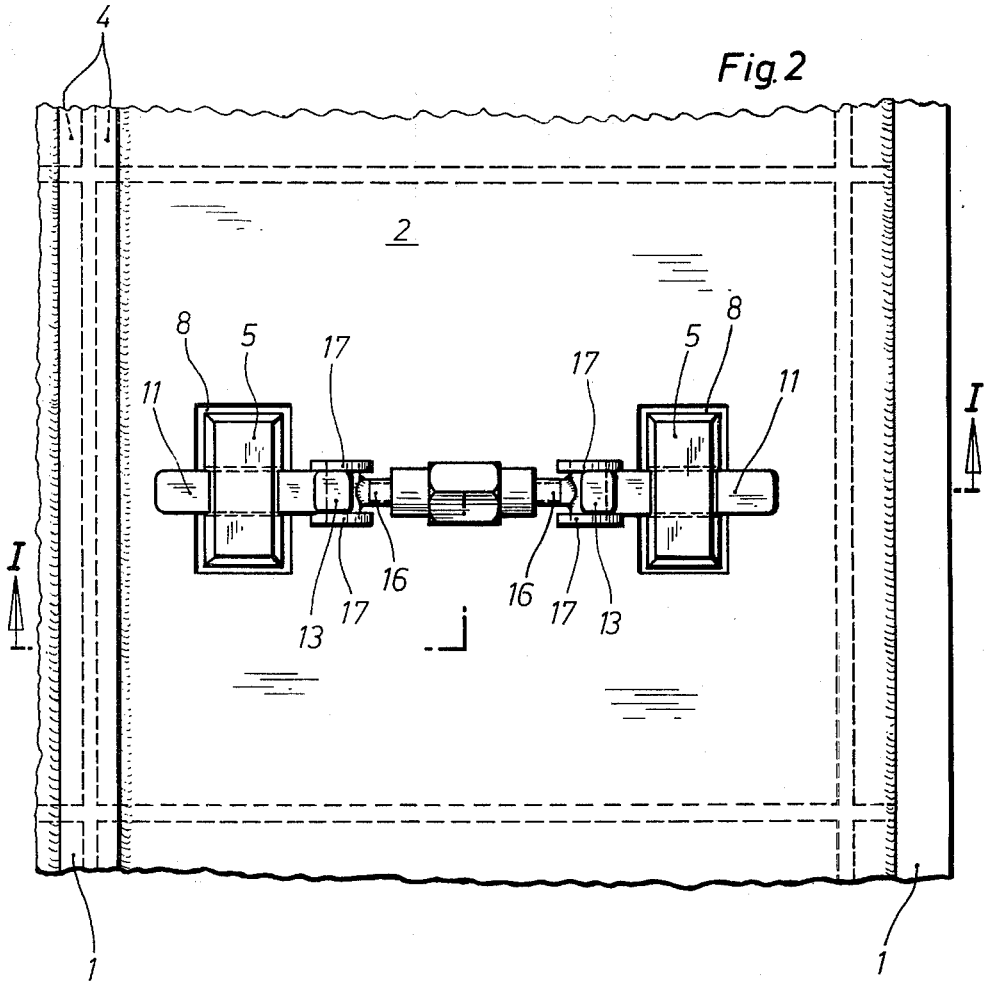
FIG. 2 is a plan view of the fixing from outside the housing and taken in the direction of the arrow II in FIG. 1.

Of the machine in accordance with the inventinon the drawings show, apart from housing side support walls 1, only the housing wall 2 which is to be lined on its inner face with wearing plates. Only one such wearing plate 3 is fully indicated in the drawings; although parts of adjacent wearing plates 4 are also shown in FIG. 2.

Each wearing plate 3, 4 is furnished with two eyelets 5 which, starting from the surface 7 of the plate 3 remote from the wearing surface 6, penetrate outwards through openings 8 in the housing wall 2. The holes 9 in the eyelets 5 are defined by plane surfaces, and of these, the remote surface 10 is slightly inclined. Wedges 11 are inserted through the eyelets 5 and the inclined surfaces 12 of the wedges co-operate with the surfaces 10 of the eyelets 5. The heads 13 of the wedges 11 face towards each other between the eyelets 5, and are each furnished with a circular recess 14. Between the heads 13 of the wedges 11, there is disposed a turnbuckle 15 of the usual form, comprising two screw-threaded bolts 16 having rounded free ends which seat in the recesses 14. When the turnbuckle 15 is expanded, the wedges 11 are driven away from each other into the eyelets 5, thereby clamping the wearing plate 3 against the housing wall 2 and also preventing either wedge from loosening as a result of impacts on the wearing plate. In order still further to improve the reliability, the screwed portions of the turnbuckle 15 can also be prevented by any of the known screw locking means against loosening. This detail is not shown. In addition, limit plates 17 are provided at the sides of the free ends of the bolts 16, the diameter of these plates exceeding twice the radius of the recesses 14, in order to prevent lateral displacement of the turnbuckle.

In the example shown, when the turnbuckle 15 is expanded, the distance between the wedges 11 is increased. An arrangement with the reverse action is however conceivable, in which the thickened ends of the wedges are remote from and not next to each other. The turnbuckle would then have to be so arranged that it would drive the wedges towards each other instead of apart. On account of its simplicity however, the arrangement described with reference to the drawings is preferred.

I claim:

1. In a material smashing machine including a housing wall, a plurality of replaceable wearing plates, and a plurality of releasable fixing means securing said wearing plates to said housing wall whereby said wearing plates from a stationary wearing wall, lining a portion of said housing wall, with the stationary wall forming the surface against which material is smashed, each of said releaseable fixing means comprising means defining an opening in said housing wall, an eyelet projecting from one of said wearing plates outwards through said opening in said housing wall, and a wedge inserted into said eyelet and bearing against the outside of said wall to hold said one wearing plate against said housing wall, and each of said wearing plates having at least one said eyelet, the improvement wherein each of said releaseable fixing means includes a releaseable self-locking clamping piece acting on said wedge in the direction of insertion of said wedge into said eyelet.

2. A machine as claimed in claim 1, further comprising a turnbuckle having two oppositely adjustable parts, one of said turnbuckle parts forming the clamping piece of one of said releasable fixing means and the other of said turnbuckle parts forming the clamping piece of another of said releasable fixing means.

3. A machine as claimed in claim 2, wherein said eyelets of said one and another releaseable fixing means associated with said turnbuckle project from the same wearing plate as each other.

* * * * *